US008726865B2

(12) United States Patent
David et al.

(10) Patent No.: US 8,726,865 B2
(45) **Date of Patent: *May 20, 2014**

(54) HARMONIC DRIVE CAMSHAFT PHASER USING OIL FOR LUBRICATION

(75) Inventors: Pascal David, Beidweiler (LU); Pierre Kimus, Attert (BE)

(73) Assignee: Delphi Technologies, Inc., Troy, MI (US)

( * ) Notice: Subject to any disclaimer, the term of this patent is extended or adjusted under 35 U.S.C. 154(b) by 268 days.

This patent is subject to a terminal disclaimer.

(21) Appl. No.: 13/155,685

(22) Filed: Jun. 8, 2011

(65) Prior Publication Data

US 2012/0312258 A1 Dec. 13, 2012

(51) Int. Cl.
*F01L 1/34* (2006.01)
*F01L 1/344* (2006.01)
*F01L 1/352* (2006.01)

(52) U.S. Cl.
CPC ..... *F01L 1/344* (2013.01); *F01L 2001/3521* (2013.01)
USPC ..... 123/90.17; 123/90.15; 464/160

(58) Field of Classification Search
CPC ..... F01L 1/344; F01L 2001/344; F01L 2001/3521
USPC ..... 123/90.15, 90.17; 464/160
See application file for complete search history.

(56) References Cited

U.S. PATENT DOCUMENTS

| | | | | |
|---|---|---|---|---|
| 3,176,670 | A * | 4/1965 | Toussaint | 123/572 |
| 3,996,816 | A * | 12/1976 | Brighton | 74/640 |
| 5,417,186 | A | 5/1995 | Elrod et al. | |
| 6,250,267 | B1 * | 6/2001 | Methley | 123/90.17 |
| 6,257,186 | B1 | 7/2001 | Heer | |
| 6,328,006 | B1 | 12/2001 | Heer | |
| 7,409,891 | B2 * | 8/2008 | Takemura | 74/640 |
| 7,421,990 | B2 | 9/2008 | Taye et al. | |
| 7,673,598 | B2 * | 3/2010 | Schaefer et al. | 123/90.15 |
| 8,322,318 | B2 * | 12/2012 | David et al. | 123/90.17 |
| 2011/0030632 | A1 | 2/2011 | David et al. | |

OTHER PUBLICATIONS

U.S. Appl. No. 12/965,057, DP-319458.
U.S. Appl. No. 12/825,806, DP-319319.
U.S. Appl. No. 12/844,918, DP-319318.
U.S. Appl. No. 13/112,199, DP-319310.
U.S. Appl. No. 13/102,138, DP-319793.

* cited by examiner

*Primary Examiner* — Ching Chang
(74) *Attorney, Agent, or Firm* — Thomas N. Twomey

(57) ABSTRACT

A camshaft phaser includes a housing with an array of internal splines formed within a bore. A harmonic gear drive unit is disposed within the housing and includes a circular spline and a dynamic spline, a flexspline disposed within the circular spline and the dynamic spline, a wave generator disposed within the flexspline, and a rotational actuator connectable to the wave generator. One of the circular spline and the dynamic spline is fixed to the housing. A hub is rotatably disposed within the housing and attachable to the camshaft and fixed to the other of the circular spline and the dynamic spline. An oil passage is provided for receiving oil from an internal combustion engine for lubricating the harmonic gear drive unit.

10 Claims, 4 Drawing Sheets

HARMONIC DRIVE CAMSHAFT PHASER USING OIL FOR LUBRICATION

TECHNICAL FIELD OF INVENTION

The present invention relates to an electric variable camshaft phaser (eVCP) which uses an electric motor and a harmonic drive unit (HD) to vary the phase relationship between a crankshaft and a camshaft in an internal combustion engine; more particularly, to an eVCP with oil passages for communicating oil to the harmonic drive unit and other elements of the eVCP from the internal combustion engine.

BACKGROUND OF INVENTION

Camshaft phasers for varying the timing of combustion valves in internal combustion engines are well known. A first element, known generally as a sprocket element, is driven by a chain, belt, or gearing from the internal combustion engine's crankshaft. A second element, known generally as a camshaft plate, is mounted to the end of an internal combustion engine's camshaft. A common type of camshaft phaser used by motor vehicle manufactures is known as a vane-type camshaft phaser. U.S. Pat. No. 7,421,989 shows a typical vane-type camshaft phaser which generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve, in accordance with an engine control module, to either the advance or retard chambers, to change the angular position of the rotor relative to the stator, and consequently the angular position of the camshaft relative to the crankshaft, as required to meet current or anticipated engine operating conditions.

While vane-type camshaft phasers are effective and relatively inexpensive, they do suffer from drawbacks. First, at low engine speeds, oil pressure tends to be low, and sometimes unacceptable. Therefore, the response of a vane-type camshaft phaser may be slow at low engine speeds. Second, at low environmental temperatures, and especially at engine start-up, engine oil displays a relatively high viscosity and is more difficult to pump, therefore making it more difficult to quickly supply engine oil to the vane-type camshaft phaser. Third, using engine oil to drive the vane-type camshaft phaser is parasitic on the engine oil system and can lead to requirement of a larger oil pump. Fourth, for fast actuation, a larger engine oil pump may be necessary, resulting in additional fuel consumption by the internal combustion engine. Lastly, the total amount of phase authority provided by vane-type camshaft phasers is limited by the amount of space between adjacent vanes and lobes. A greater amount of phase authority may be desired than is capable of being provided between adjacent vanes and lobes. For at least these reasons, the automotive industry is developing electrically driven camshaft phasers.

One type of electrically driven camshaft phaser being developed uses a harmonic drive gear unit, actuated by an electric motor, to change the angular position of the camshaft relative to the crankshaft. Examples of such camshaft phasers are shown in U.S. Pat. Nos. 5,417,186; 6,328,006; and 7,421,990. However, none of these examples provide oil from the internal combustion engine in order to lubricate the harmonic gear unit and other components of the camshaft phaser that may benefit from oil to increase durability of the camshaft phaser.

What is needed is an eVCP which utilizes oil from an internal combustion engine to lubricate the harmonic gear drive unit and other elements of the eVCP. What is also needed is such a camshaft phaser that receives only enough oil from the internal combustion engine to provide long term durability of the eVCP while not requiring increased capacity of a lubrication system of the internal combustion engine.

SUMMARY OF THE INVENTION

Briefly described, a camshaft phaser is provided for controllably varying the phase relationship between a crankshaft and a camshaft in an internal combustion engine. The camshaft phaser includes a housing having a bore with a longitudinal axis and a harmonic gear drive unit is disposed therein. The harmonic gear drive unit includes a circular spline and a dynamic spline, a flexspline disposed within the circular spline and the dynamic spline, a wave generator disposed within the flexspline, and a rotational actuator connectable to the wave generator. One of the circular spline and the dynamic spline is fixed to the housing in order to prevent relative rotation therebetween. A hub is rotatably disposed within the housing and attachable to the camshaft and fixed to the other of the circular spline and the dynamic spline in order to prevent relative rotation therebetween. A harmonic drive oil passage is provided for receiving oil, in use, from the internal combustion engine. The harmonic drive oil passage is in fluid communication with the harmonic gear drive unit for supplying the oil thereto.

BRIEF DESCRIPTION OF DRAWINGS

This invention will be further described with reference to the accompanying drawings in which.

DETAILED DESCRIPTION OF INVENTION

Figure 1:
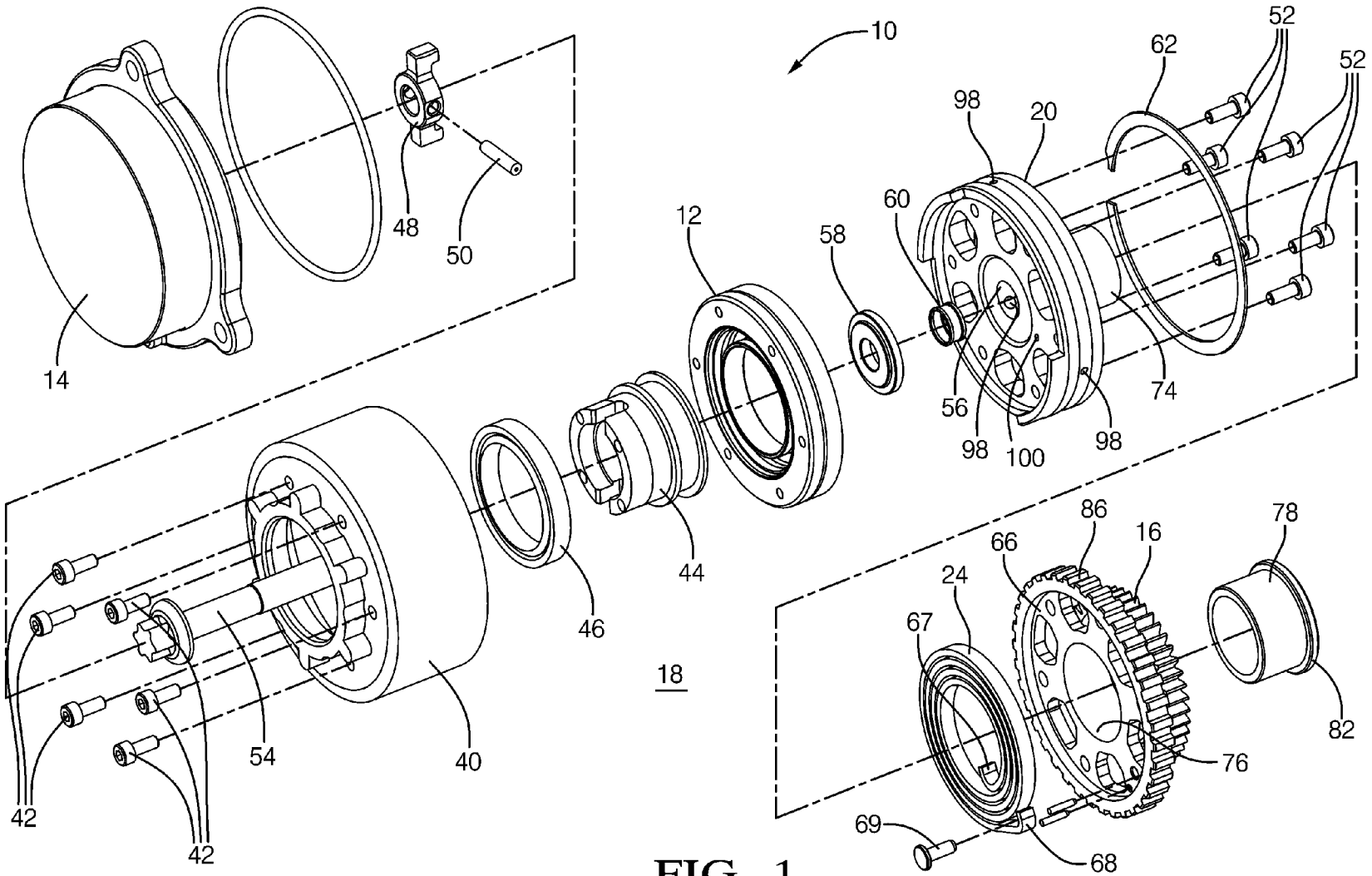
FIG. 1 is an exploded isometric view of an eVCP in accordance with the present invention.
Figure 2:
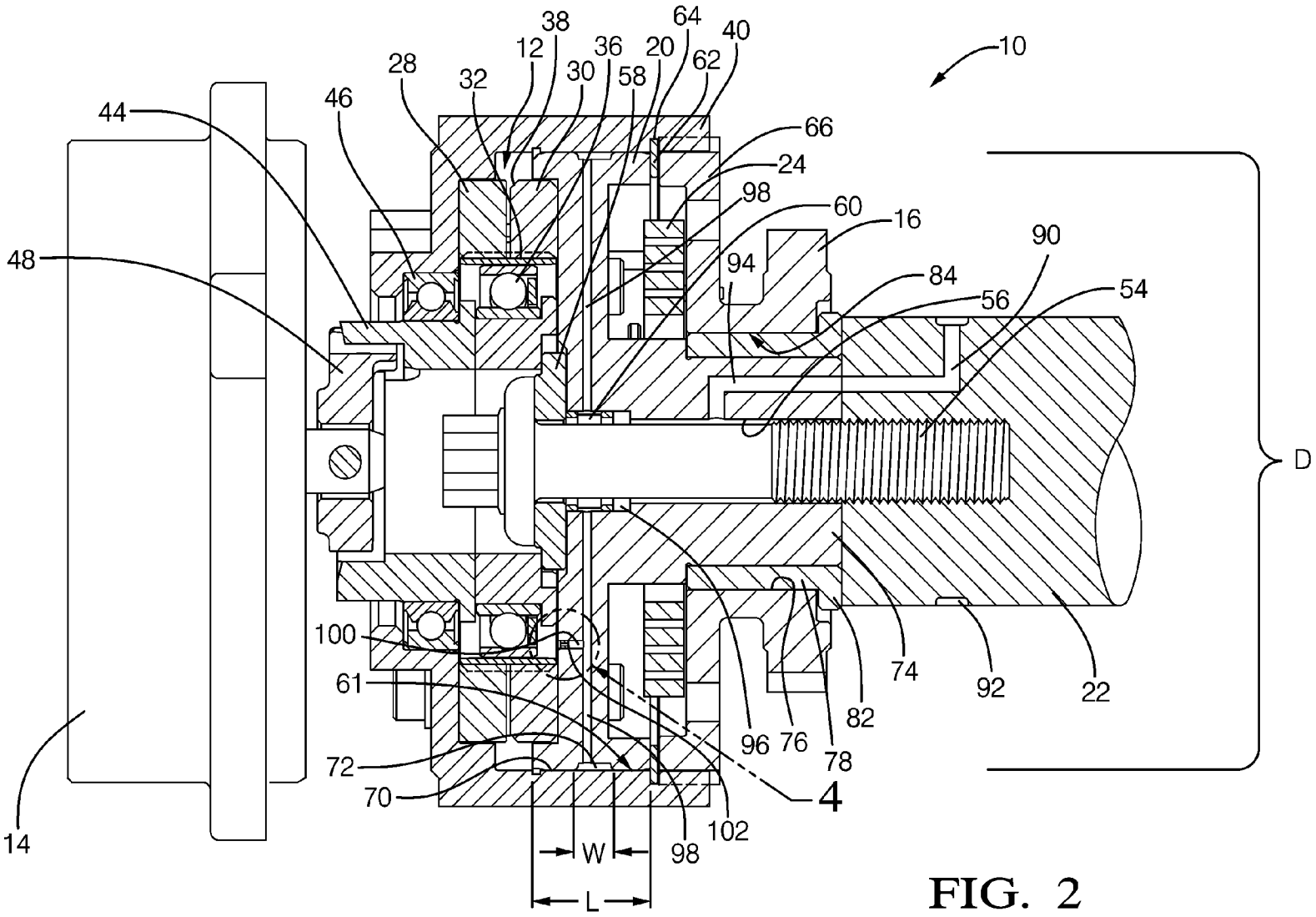
FIG. 2 is an axial cross-section of an eVCP in accordance with the present invention.

Referring to FIGS. 1 and 2, eVCP 10 in accordance with the present invention comprises flat harmonic gear drive unit 12; rotational actuator 14 that may be a hydraulic motor but is preferably a DC electric motor, operationally connected to harmonic gear drive unit 12; input sprocket 16 operationally connected to harmonic gear drive unit 12 and drivable by a crankshaft (not shown) of internal combustion engine 18; output hub 20 attached to harmonic gear drive unit 12 and mountable to an end of camshaft 22 of internal combustion engine 18; and bias spring 24 operationally disposed between output hub 20 and input sprocket 16. Electric motor 14 may be an axial-flux DC motor.

Harmonic gear drive unit 12 comprises an outer first spline 28 which may be either a circular spline or a dynamic spline as described below; an outer second spline 30 which is the opposite (dynamic or circular) of first spline 28 and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32.

Flexspline 32 is a non-rigid ring with external teeth on a slightly smaller pitch diameter than the circular spline. It is fitted over and elastically deflected by wave generator 36.

The circular spline is a rigid ring with internal teeth engaging the teeth of flexspline 32 across the major axis of wave generator 36.

The dynamic spline is a rigid ring having internal teeth of the same number as flexspline 32. It rotates together with flexspline 32 and serves as the output member. Either the dynamic spline or the circular spline may be identified by a chamfered corner 38 at its outside diameter to distinguish one spline from the other.

As is disclosed in the prior art, wave generator 36 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of harmonic gear drive unit 12, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 12 is thus a high-ratio gear transmission; that is, the angular phase relationship between first spline 28 and second spline 30 changes by 2% for every revolution of wave generator 36.

Of course, as will be obvious to those skilled in the art, the circular spline rather may have slightly more teeth than the dynamic spline has, in which case the rotational relationships described below are reversed.

Still referring to FIGS. 1 and 2, input sprocket 16 is rotationally fixed to a generally cup-shaped sprocket housing 40 that is fastened by bolts 42 to first spline 28. Coupling adaptor 44 is mounted to wave generator 36 and extends through sprocket housing 40, being supported by bearing 46 mounted in sprocket housing 40. Coupling 48 mounted to the motor shaft of electric motor 14 and pinned thereto by pin 50 engages coupling adaptor 44, permitting wave generator 36 to be rotationally driven by electric motor 14, as may be desired to alter the phase relationship between first spline 28 and second spline 30.

Output hub 20 is fastened to second spline 30 by bolts 52 and may be secured to camshaft 22 by camshaft phaser attachment bolt 54 extending through output hub axial bore 56 in output hub 20, and capturing stepped thrust washer 58 and filter 60 recessed in output hub 20. In an eVCP, it is necessary to limit radial run-out between the input hub and output hub. In the prior art, this has been done by providing multiple roller bearings to maintain concentricity between the input and output hubs. Referring to FIG. 2, radial run-out is limited by a single journal bearing interface 61 between sprocket housing 40 (input hub) and output hub 20, thereby reducing the overall axial length of eVCP 10 and its cost to manufacture. Output hub 20 is retained within sprocket housing 40 by snap ring 62 disposed in an annular groove 64 formed in sprocket housing 40.

Back plate 66, which is integrally formed with input sprocket 16, captures bias spring 24 against output hub 20. Inner spring tang 67 is engaged by output hub 20, and outer spring tang 68 is attached to back plate 66 by pin 69. In the event of an electric motor malfunction, bias spring 24 is biased to back-drive harmonic gear drive unit 12 without help from electric motor 14 to a rotational position of second spline 30 wherein internal combustion engine 18 will start or run, which position may be at one of the extreme ends of the range of authority or intermediate of the phaser's extreme ends of its rotational range of authority. For example, the rotational range of travel in which bias spring 24 biases harmonic gear drive unit 12 may be limited to something short of the end stop position of the phaser's range of authority. Such an arrangement would be useful for internal combustion engines requiring an intermediate park position for idle or restart.

The nominal diameter of output hub 20 is D; the nominal axial length of first journal bearing 70 is L; and the nominal axial length of the oil groove 72 formed in either output hub 20 (shown) and/or in sprocket housing 40 (not shown) for supplying oil to first journal bearing 70 is W. In addition to journal bearing clearance, the length L of the journal bearing in relation to output hub diameter D controls how much output hub 20 can tip within sprocket housing 40. The width of oil groove 72 in relation to journal bearing length L controls how much bearing contact area is available to carry the radial load. Experimentation has shown that a currently preferred range of the ratio L/D may be between about 0.25 and about 0.40, and that a currently preferred range of the ratio W/L may be between about 0.15 and about 0.70. The supply of oil to oil groove 72 will be discussed in more detail later.

Extension portion 74 of output hub 20 receives bushing 78 in a press fit manner. In this way, output hub 20 is fixed to bushing 78. Input sprocket axial bore 76 interfaces in a sliding fit manner with bushing 78 to form second journal bearing 84. This provides support for the radial drive load placed on input sprocket 16 and prevents the radial drive load from tipping first journal bearing 70 which could cause binding and wear issues for first journal bearing 70. Bushing 78 includes radial flange 82 which serves to axially retain back plate 66/input sprocket 16. Alternatively, but not shown, bushing 78 may be eliminated and input sprocket axial bore 76 could interface in a sliding fit manner with extension portion 74 of output hub 20 to form second journal bearing 84 and thereby provide the support for the radial drive load placed on input sprocket 16. In this alternative, back plate 66/input sprocket 16 may be axially retained by a snap ring (not shown) received in a groove (not shown) of extension portion 74.

Figure 3:
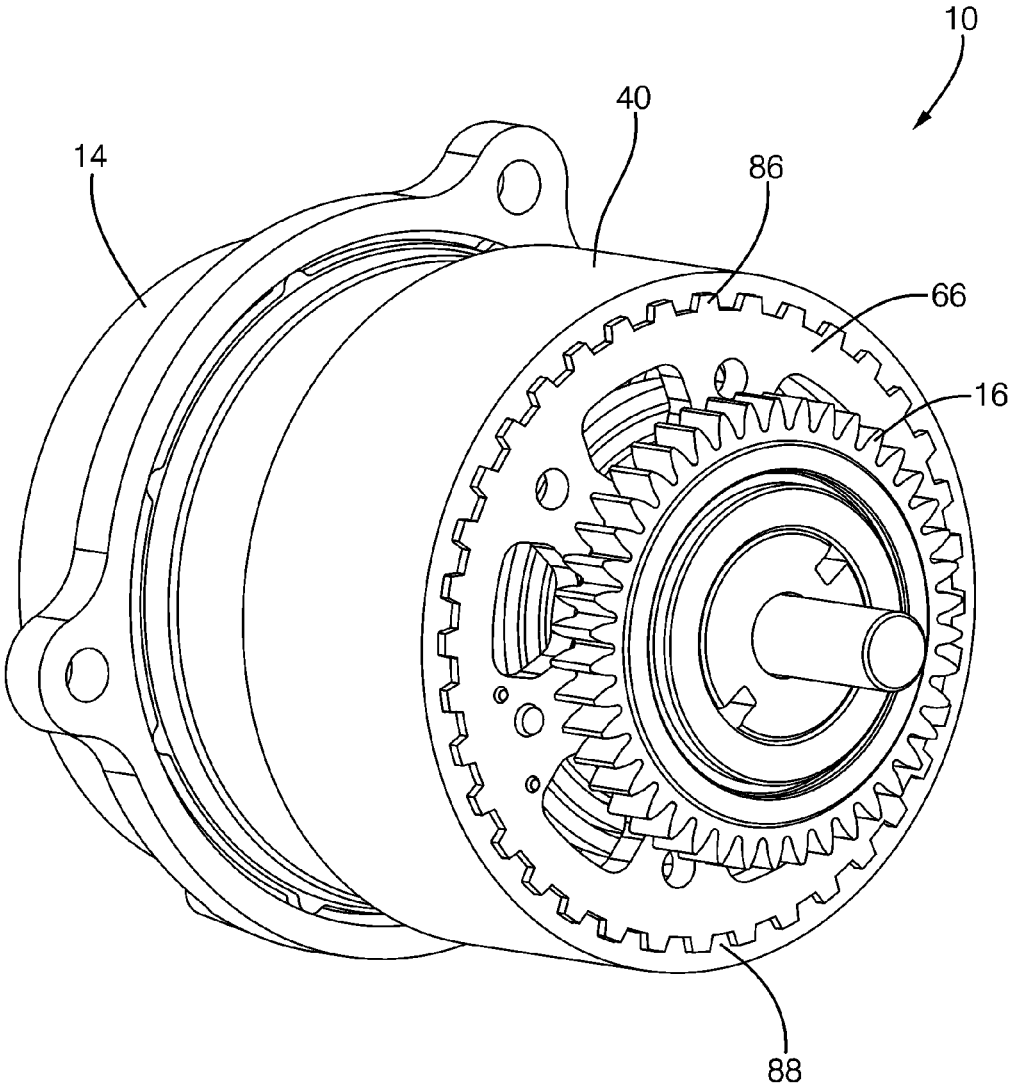
FIG. 3 is an isometric view of an eVCP in accordance with the present invention.

In order to transmit torque from input sprocket 16/back plate 66 to sprocket housing 40 and referring to FIGS. 1-3, a sleeve gear type joint is used in which back plate 66 includes external splines 86 which slidingly fit with internal splines 88 included within sprocket housing 40. The sliding fit nature of the splines 86, 88 eliminates or significantly reduces the radial tolerance stack issue between first journal bearing 70 and second journal bearing 84 because the two journal bearings 70, 84 operate independently and do not transfer load from one to the other. If this tolerance stack issue were not resolved, manufacture of the two journal bearings would be prohibitive in mass production because of component size and concentricity tolerances that would need to be maintained. The sleeve gear arrangement also eliminates then need for a bolted flange arrangement to rotationally fix back plate 66 to sprocket housing 40 which minimizes size and mass. Additionally, splines 86, 88 lend themselves to fabrication methods where they can be net formed onto back plate 66 and into sprocket housing 40 respectively. Splines 86, 88 may be made, for example, by powder metal process or by standard gear cutting methods.

In order to lubricate various elements of eVCP 10, oil is provided thereto from internal combustion engine 18 through camshaft oil passage 90 which receives oil from annular camshaft oil groove 92 of camshaft 22. Annular camshaft oil groove 92 is supplied with oil by an oil gallery (not shown) of a camshaft bearing (also not shown). When eVCP 10 is attached to camshaft 22, annular camshaft oil groove 92 is in fluid communication with oil supply passage 94 formed in extension portion 74. Oil supply passage 94 is in fluid communication with output hub axial bore 56 for communicating oil to annular oil chamber 96 formed radially between camshaft phaser attachment bolt 54 and output hub axial bore 56. From annular oil chamber 96, the oil passes through filter 60 to prevent contaminants from passing further into eVCP 10. Filter 60 is a band-type filter that may be a screen or mesh and may be made from any number of different materials that are known in the art of oil filtering. After passing through filter 60, the oil is communicated to bearing surface oil passages 98 which extend radially through output hub 20 from output hub axial bore 56 to oil groove 72 for lubricating first journal bearing 70.

Bearing surface oil passages 98 may need to be formed of a diameter that is capable of supplying more oil than is necessary to lubricate first journal bearing 70. This is the result of the relatively long length of bearing surface oil passages 98 which may be formed, for example, by a drill. In order to prevent drill breakage and drill wander, a drill of sufficient diameter is needed to limit these undesired outcomes. While a drill of sufficient diameter to limit drill breakage and drill wander may produce bearing surface oil passages 98 that are capable of supplying more oil than is necessary to lubricate first journal bearing 70, the close fitting nature of output hub 20 to sprocket housing 40 restricts the flow of oil to a minimal amount needed for lubrication of first journal bearing 70. In this way, lubrication of first journal bearing 70 is accomplished with minimal impact to the lubrication system of internal combustion engine 18.

Oil originating from camshaft oil passage 90 may also be used to lubricate second journal bearing 84. Lubricating second journal bearing 84 may be accomplished by proving a second journal bearing oil passage (not shown) which extends radially though extension portion 74 and bushing 78 from oil supply passage 94 or from output hub axial bore 56. Alternatively, lubrication of second journal bearing 84 may be accomplished by providing a second journal bearing oil passage (not shown) which extends through output hub 20 from one or more bearing surface oil passages 98 to second journal bearing 84.

Figure 4:
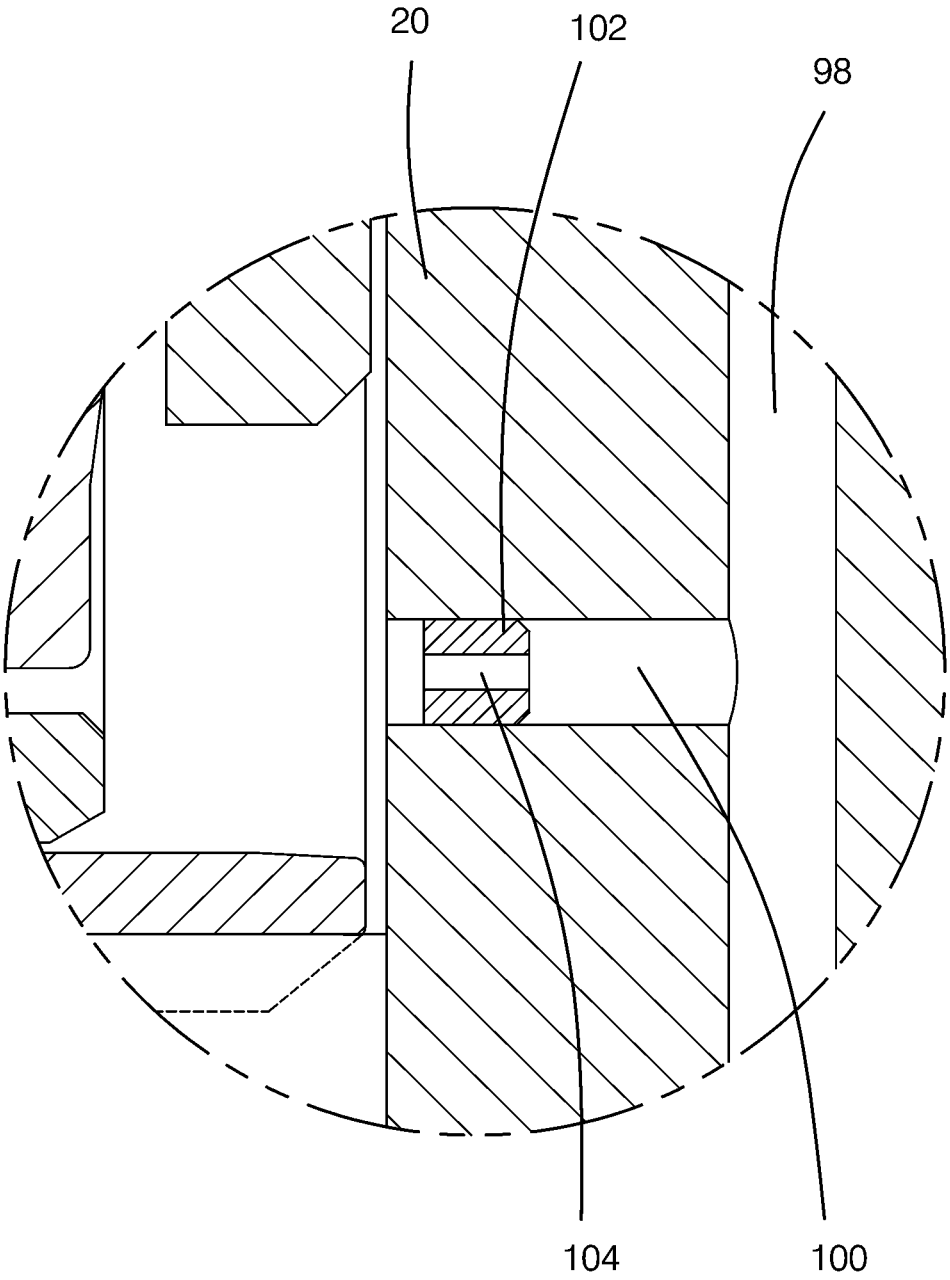
FIG. 4 is an enlarged view of circle 4 from FIG. 2 showing an orifice in accordance with the present invention.

Oil is also used to lubricate harmonic gear drive unit 12 and bearing 46. In order to supply oil thereto and referring to FIGS. 1, 2, and 4; harmonic drive oil passage 100 is provided axially through output hub 20 beginning at one of the bearing surface oil passages 98 and extending toward harmonic gear drive unit 12 substantially parallel to the axis of rotation of eVCP 10. In this way, oil from bearing surface oil passage 98 is communicated to harmonic gear drive unit 12 and bearing 46.

For convenience of manufacture, harmonic drive oil passage 100 may be formed with the same diameter drill as used to form bearing surface oil passages 98. However, unlike first journal bearing 70, harmonic gear drive unit 12 and bearing 46 may not provide sufficient restriction to limit the flow of oil through harmonic drive oil passage 100. This may result in insufficient oil being supplied to first journal bearing 70 as well as an unnecessary drain on the lubrication system of internal combustion engine 18. In order to limit the amount of oil supplied to harmonic gear drive unit 12 and bearing 46, plug 102 having orifice 104 therethrough may be inserted into harmonic drive oil passage 100. Orifice 104 has a diameter that is sized to provide sufficient oil to harmonic gear drive unit 12 and bearing 46 for lubrication thereof while not negatively affecting the supply of oil to first journal bearing 70 and having a minimal impact to the lubrication system of internal combustion engine 18. Plug 102 may be retained within harmonic drive oil passage 100, for example, by press fit.

Alternatively, but not shown, plug 102 may be eliminated by forming harmonic drive oil passage 100 sufficiently small as to provide sufficient oil to harmonic gear drive unit 12 and bearing 46 for lubrication thereof while not negatively affecting the supply of oil to first journal bearing 70 and having a minimal impact to the lubrication system of internal combustion engine 18. This may be accomplished, for example, by using a drill smaller in diameter that the drill used form bearing surface oil passages 98, by using electrical discharge machining (EDM), or by using a laser.

While the embodiment described herein describes input sprocket 16 as being smaller in diameter than sprocket housing 40 and disposed axially behind sprocket housing 40, it should now be understood that the input sprocket may be radially surrounding the sprocket housing and axially aligned therewith. In this example, the back plate may be press fit into the sprocket housing rather than having a sleeve gear type joint.

The embodiment described herein describes harmonic gear drive unit 12 as comprising outer first spline 28 which may be either a circular spline or a dynamic spline which serves as the input member; an outer second spline 30 which is the opposite (dynamic or circular) of first spline 28 and which serves as the output member and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32. As described, harmonic gear drive unit 12 is a flat plate or pancake type harmonic gear drive unit as referred to in the art. However, it should now be understood that other types of harmonic gear drive units may be used in accordance with the present invention. For example, a cup type harmonic gear drive unit may be used. The cup type harmonic gear drive unit comprises a circular spline which serves as the input member; a flexspline which serves as the output member and which is disposed radially inwards of the circular spline and having outwardly-extending gear teeth disposed for engaging inwardly-extending gear teeth on the circular spline; and a wave generator disposed radially inwards of and engaging the flexspline.

While the invention has been described by reference to various specific embodiments, it should be understood that numerous changes may be made within the spirit and scope of the inventive concepts described. Accordingly, it is intended that the invention not be limited to the described embodiments, but rather only to the extent set forth in the claims that follow.

We claim:

1. A camshaft phaser for controllably varying the phase relationship between a crankshaft and a camshaft in an internal combustion engine, said camshaft phaser comprising:

a housing having a bore with a longitudinal axis;

a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, and a rotational actuator connectable to said wave generator such that rotation of said wave generator causes relative rotation between said circular spline and said dynamic spline, wherein one of said circular spline and said dynamic spline is fixed to said housing in order to prevent relative rotation therebetween;

a hub rotatably disposed within said housing axially adjacent to said harmonic gear drive unit and attachable to said camshaft and fixed to the other of said circular spline and said dynamic spline in order to prevent relative rotation therebetween; and a harmonic drive oil passage through said hub for receiving oil, in use, from said internal combustion engine, said harmonic drive oil passage being in fluid communication with said harmonic gear drive unit for supplying said oil thereto.

2. A camshaft phaser as in claim 1 wherein a bearing surface interface is formed between said housing and said hub, and wherein a bearing surface oil passage is in fluid communication with said bearing surface interface for supplying said oil thereto.

3. A camshaft phaser as in claim 2 wherein said harmonic drive oil passage is in fluid communication with said bearing surface oil passage for receiving said oil therefrom.

4. A camshaft phaser as in claim 3 wherein said harmonic drive oil passage includes an orifice for restricting the flow of oil therethrough.

5. A camshaft phaser as in claim 4 wherein said orifice is formed in a plug that is inserted within said harmonic drive oil passage.

6. A camshaft phaser as in claim 2 wherein said bearing surface oil passage is formed radially through said hub.

7. A camshaft phaser as in claim 6 wherein said harmonic drive oil passage extends from said bearing surface oil passage in a direction substantially parallel to said longitudinal axis.

8. A camshaft phaser as in claim 6 further comprising:

an axial bore extending coaxially through said hub;

a camshaft phaser attachment bolt extending coaxially through said axial bore and being threadably engageable with said camshaft for attaching said camshaft phaser to said camshaft, said camshaft phaser attachment bolt defining an annular oil chamber with said axial bore; and an oil supply passage through said hub for supplying said oil from said internal combustion engine to said annular oil chamber;

wherein said annular oil chamber is in fluid communication with said bearing surface oil passage for communicating said oil thereto.

9. A camshaft phaser as in claim 8 further comprising a filter disposed within said annular oil chamber for substantially preventing particulate matter from entering said bearing surface oil passage and said harmonic drive oil passage.

10. A camshaft phaser as in claim 1 further comprising:

a coupling adapter attached coaxially to said wave generator and said rotational actuator for transmitting rotary motion from said rotational actuator to said wave generator; and a bearing supporting said coupling adapter;

wherein said harmonic drive oil passage is in fluid communication with said bearing for supplying said oil thereto.

* * * * *